US010751740B2

(12) United States Patent
Passetti et al.

(10) Patent No.: US 10,751,740 B2
(45) Date of Patent: Aug. 25, 2020

(54) ECO PUMP ASSEMBLY

(71) Applicant: Tessy Plastics Corporation, Elbridge, NY (US)

(72) Inventors: Benjamin Passetti, Weedsport, NY (US); Richard Smith, Hannibal, NY (US); Brian Anderson, Baldwinsville, NY (US); Adam Paul Vallee, Cato, NY (US)

(73) Assignee: Tessy Plastics Corporation, Elbridge, NY (US)

( * ) Notice: Subject to any disclaimer, the term of this patent is extended or adjusted under 35 U.S.C. 154(b) by 0 days.

(21) Appl. No.: 16/243,483

(22) Filed: Jan. 9, 2019

(65) Prior Publication Data

US 2020/0215560 A1 Jul. 9, 2020

(51) Int. Cl.
*B05B 11/00* (2006.01)

(52) U.S. Cl.
CPC ..... *B05B 11/0094* (2013.01); *B05B 11/3025* (2013.01)

(58) Field of Classification Search
CPC ..... B05B 11/0094; B05B 11/3025
USPC ..... 222/321.6, 321.2, 321.7–321.9
See application file for complete search history.

(56) References Cited

U.S. PATENT DOCUMENTS 3,664,548 A 5/1972 Broderick
3,893,627 A 7/1975 Siczek et al.
3,949,910 A * 4/1976 Focht ..... B05B 11/3023 222/321.9
5,307,962 A * 5/1994 Lin ..... B05B 11/0064 222/321.9
5,651,480 A * 7/1997 Piepenstock ..... B05B 11/3077 222/321.9
6,729,505 B2 * 5/2004 Ramsey ..... B05B 11/3001 222/321.9
2004/0026458 A1 * 2/2004 Fuchs ..... B05B 11/0064 222/321.6
2005/0006412 A1 * 1/2005 Albisetti ..... B05B 11/0062 222/321.9
2009/0102106 A1 * 4/2009 Ohashi ..... F16F 1/025 267/153
2012/0234862 A1 * 9/2012 Kharbanda ..... B05B 11/0037 222/173

(Continued)

FOREIGN PATENT DOCUMENTS

EP 1364719 A1 11/2003
KR 20040062303 A 7/2004

OTHER PUBLICATIONS

PCT/US2020/012442; filed Jan. 7, 2020; International Search Report and Written Opinion; dated Apr. 1, 2020 (8 pages).

*Primary Examiner* — Lien M Ngo
(74) *Attorney, Agent, or Firm* — Barclay Damon LLP

(57) ABSTRACT

A pump assembly for a pump assembly for a dispenser container comprises a cap having a housing and a spout and a collar having a stop member. A sleeve is at least partially positioned within the collar and comprises a sleeve chamber. A plurality of resilient members are housed within the sleeve chamber. Compression of the cap causes compression of the plurality of resilient members and engagement of the cap with the stop member of the collar. The cap, the collar, the sleeve, the at least one valve, and the plurality of resilient members are comprised of a same type of recyclable material.

12 Claims, 15 Drawing Sheets

(56) References Cited

U.S. PATENT DOCUMENTS

| | | | | |
|---|---|---|---|---|
| 2012/0325861 | A1* | 12/2012 | Pardonge | B05B 11/3018 222/321.7 |
| 2015/0090741 | A1* | 4/2015 | Laffey | F16F 1/025 222/341 |
| 2019/0076864 | A1* | 3/2019 | Nilsson | A47K 5/1209 |

* cited by examiner

200

ECO PUMP ASSEMBLY

This application is generally directed to the field of pump assemblies for dispensing containers and more specifically to a pump assembly using one or more resilient members that deliver robust performance while being comprised completely of components made of the same type of recyclable material such that it is easy and also cost-effective to recycle.

BACKGROUND

Pump dispensers generally comprise a pump assembly coupled to a dispensing container. Currently, pump dispensers are a common form of packaging for products like toothpaste, liquid soap, lotion, cleaning supplies, and many other useful items. Pump dispensers allow the user to carefully control the dispensing of the product from the dispensing container into their hands or onto another surface. The current pump assemblies are generally comprised of multiple components such as an actuator, a spring, a housing, and a dip tube. Many of these pump assemblies are used in conjunction with dispenser containers that are recyclable, however, many of the spring components of the current pump assemblies are manufactured from non-recyclable materials for the sake of durability and cost efficiency.

For example, in many of the current pump assemblies, one or more of the components, such as the spring, is made of metal, which allows the pumping assembly to last a long time as is the case with refillable lotion or liquid soap pumps. Since the metal components are not recyclable in the same manner as the other components of the pumping assembly, additional processing would need to be performed prior to recycling. The additional processing separates out any non-recyclable components or components not made of the same type of recyclable material. However, this additional processing takes extra time and costs money for the recycling companies, manufacturers, and/or users. In many instances, consumers simply throw away the pump assemblies rather than spend time dismantling the pump assembly for proper recycling.

Other pump assemblies use springs that are made of amorphous thermoplastic polyetherimide (PEI) resins, such as Ultem™. Such springs can hold up to frequent use, however these PEI resins are not recyclable and additional processing of the spent pump is still required in order to remove the non-recyclable components. Another type of pump assembly uses bellows rather than a spring. These bellows are formed from a rigid thermoplastic elastomer (TPE), which is a recyclable material, however this pump assembly uses several different types of dissimilar recyclable material. Consequently, additional processing of the spent pump is still required in order to properly recycle all of the components of the pump assembly.

The foregoing background describes some, but not necessarily all, of the problems, disadvantages and shortcomings related to current pump assemblies used in pump dispensers. There is a general and pervasive need in the field to provide a pump assembly which is robust with all of its components made from the same recyclable material so that it is easy and efficient to recycle.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

The following discussion relates to various embodiments of a pump assembly for a dispensing container (not shown). It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", "first", "second", and the like are not intended to limit these concepts, except where so specifically indicated. The terms "about" or "approximately" as used herein may refer to a range of 80%-125% of the claimed or disclosed value. With regard to the drawings, their purpose is to depict salient features of the pump assembly and are not specifically provided to scale.

Figure 1:
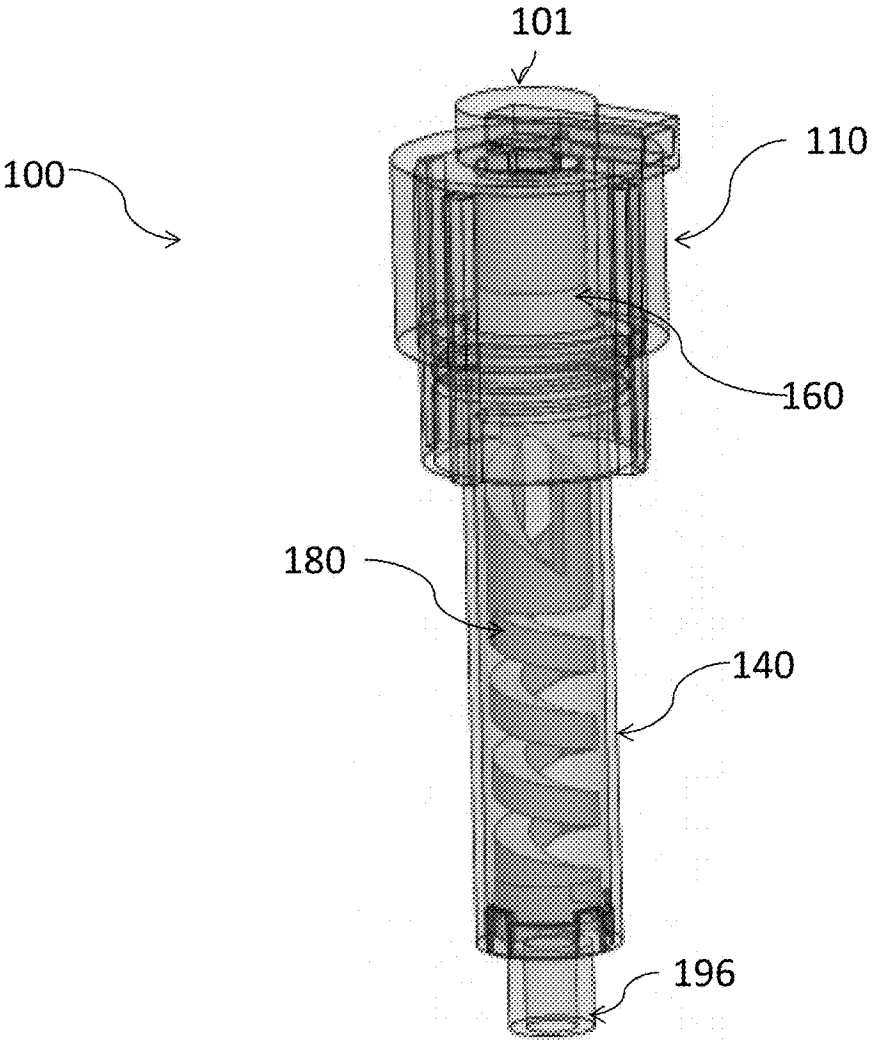
FIG. 1 illustrates a transparent view of an embodiment of a pump assembly.
Figure 2:
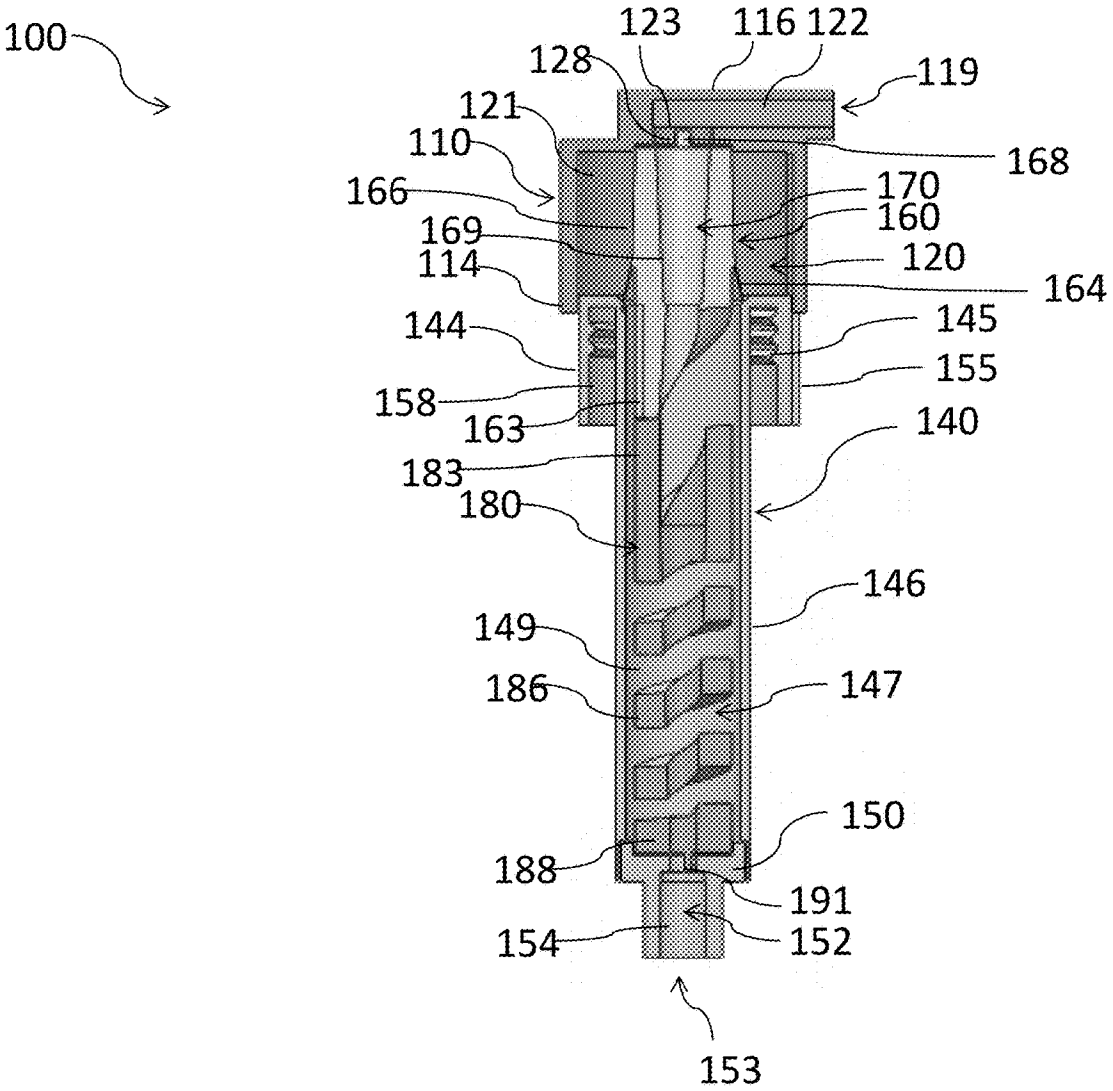
FIG. 2 illustrates a cross-sectional view of an embodiment of the pump assembly.

Referring to FIGS. 1-2, a pump assembly 100 for a dispenser container (not shown) has a top end 101 and a bottom end 102 and generally includes a cap 110, a sleeve 140, a plunger 160, and a torsion compression spring 180 positioned at least partially within the sleeve 140.

Figures 3A, 3B, 3C:
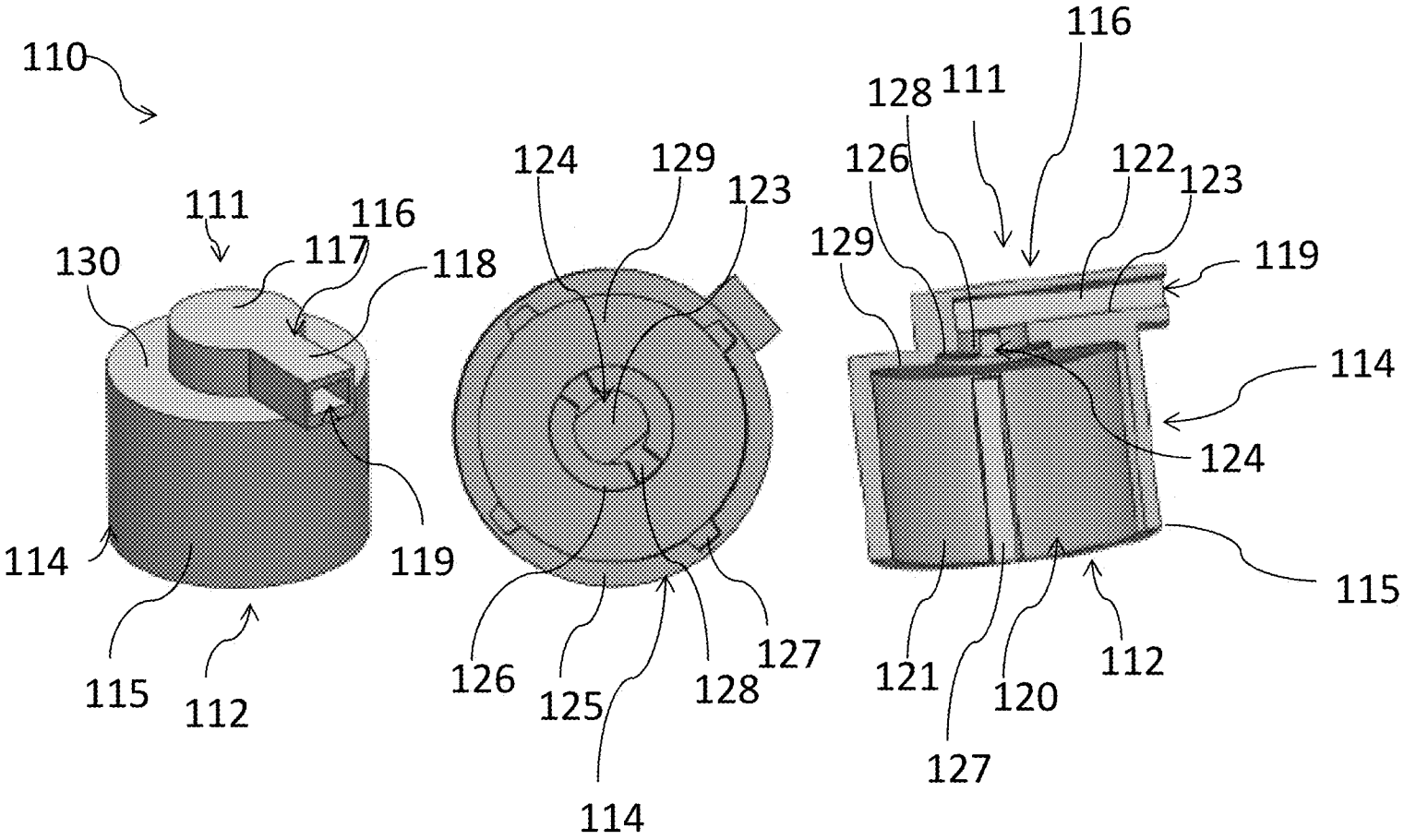
FIG. 3A illustrates perspective view of an embodiment of a cap of the pump assembly.
FIG. 3B illustrates a bottom plan view of the cap from FIG. 3A.
FIG. 3C illustrates a cross-sectional view of the cap from FIGS. 3A-3B.

As shown in FIG. 1, the cap 110 is generally positioned at a top end 101 of the pump assembly 100 and may at least partially house a portion of the sleeve 140. Referring to FIGS. 3A-3C, the cap 110 has a top end 111 and a bottom end 112. A cap housing 114 is positioned toward the bottom end 112 and a spout 116 (FIGS. 3A and 3C) positioned toward the top end 111 of the cap 110. The cap housing 114 may also comprise an exterior side surface 115 and an exterior top surface 130 (FIG. 3A). As shown in FIG. 3A, the exterior side surface 115 of the cap housing 114 is substantially smooth and cylindrical in shape, however in other embodiments the exterior side surface 115 may not be substantially smooth and cylindrical in shape. For example, the exterior side surface may have a cross-section that is polygonal in shape and not a circle. The exterior top surface 130 and the exterior side surface 115 may extend along planes that are perpendicular to each other. In other embodiments, the two surfaces may extend along planes that intersect with each other.

Referring to FIG. 3A, a spout 116 is located on the exterior top surface 130 of the cap 110 and may comprise a housing engagement portion 117 and an evacuation portion 118. In the embodiment shown in FIGS. 3A-3C, the evacuation portion 118 may have a smaller diameter than the housing engagement portion 117, however in other embodiments, the evacuation portion 118 may not have a smaller diameter than the housing engagement portion 117. In an embodiment, one or more of the components of the spout 116 may be located within the cap housing 114 such that they are not visible on an exterior surface 115, 130 of the cap housing 114.

Referring to FIGS. 3B and 3C, the cap housing 114 further includes a rim 125 (3B) located at the bottom end 112 of the cap 110 and having a circumference. An interior side surface 121 and an interior top surface 129 define an interior space 120 of the cap housing 114. As shown, the interior side surface 121 is substantially cylindrical in shape and may include one or more surface features such as channels 127 (FIG. 3C), grooves, ridges, or any other surface feature that may aid in the function or assembly of the pump assembly. The interior top surface 129 may include one or more annular recesses 126 that may define an outlet channel 124 that connects to the interior space 120 of the cap housing 114. As shown in FIG. 3B, the outlet channel 124 may connect to one or more radial channels 128, which extend from the outlet channel 124 toward the interior side surface 121 of the cap housing 114.

Still referring to FIGS. 3B and 3C, the spout 116 may further comprise a dispensing channel 122 defined by a dispensing channel surface 123. As shown in FIG. 3C, the dispensing channel 122 extends from the outlet channel 124 to an evacuation opening 119. The interior space 120, outlet channel 124, one or more radial channels 128 and the dispensing channel 122 may be fluidly connected to each other. In another embodiment, one or more of the interior space 120, outlet channel 124, one or more radial channels 128 and the dispensing channel 122, may not be fluidly connected to each other. As shown in FIGS. 3A-3C, the cap housing 114 and the spout 116 are formed as a single component, however in another embodiment, the cap housing 114 and spout 116 may be formed as separate components and coupled together using an adhesive, one or more welded joints, or any other suitable means of coupling.

Figure 4B:
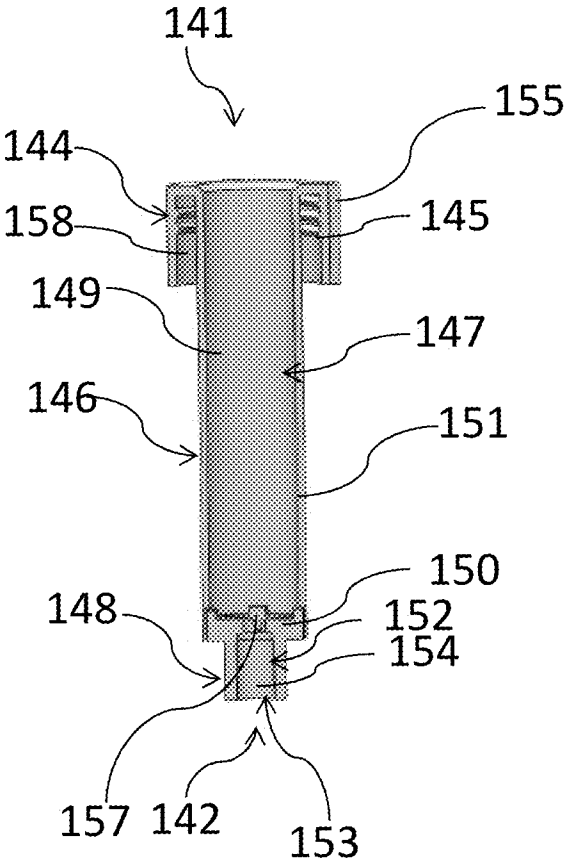
FIG. 4B illustrates a cross-sectional view of the embodiment of the sleeve from FIG. 4A.
Figure 4A:
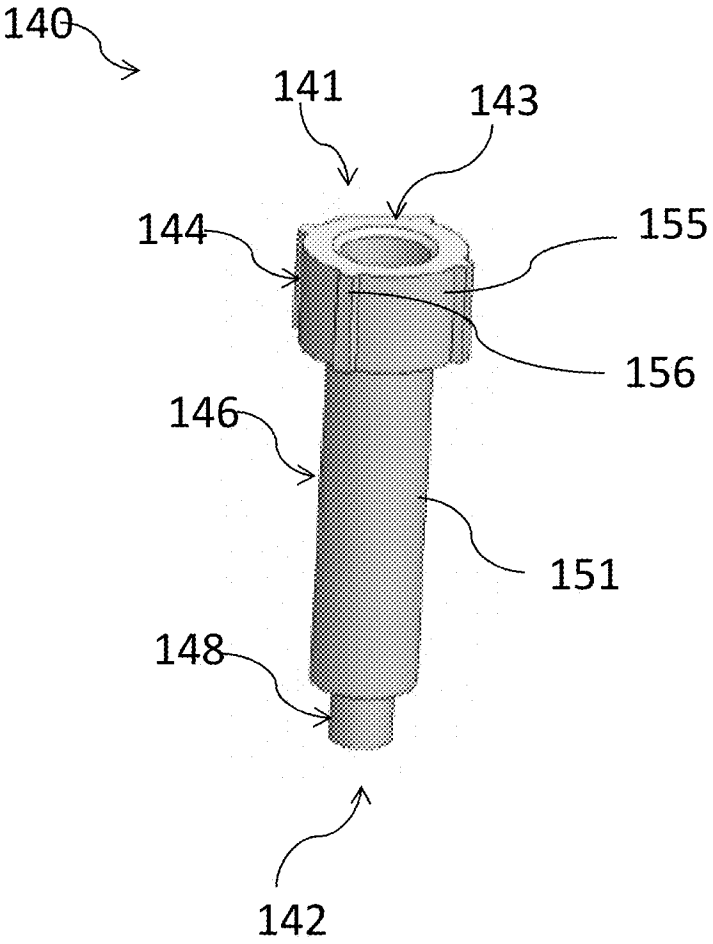
FIG. 4A illustrates an isometric view of an embodiment of a sleeve of the pump assembly.

Referring to FIGS. 4A and 4B, the sleeve 140 has a top end 141 and a bottom end 142 and may generally comprise a barrel 146 with a collar 144 coupled to the top end 141 and a coupling portion 148 positioned at the bottom end 142. The collar 144 may further comprise an outer surface 155 that includes one or more surface features. As shown in FIG. 4A, the outer surface 155 of the collar 144 may comprise one or more vertical ridges 156 (FIG. 4A), which extend in a direction that is approximately parallel to a longitudinal axis of the sleeve 140. Referring to FIGS. 2 and 4B, the diameter of the collar 144 may be greater than the diameter of the sleeve 140. As such, the outer surface 155 may be spaced away from the exterior surface of the barrel 146 and may include one or more surface features 145 on a barrel facing surface 158 of the collar 144. The one or more surface features 145 of the barrel facing surface 158 may be configured to engage a portion of the dispensing container (not shown). As shown in FIGS. 2 and 4B, the one or more surface features 145 may be a plurality of threads configured to engage a plurality of complimentary threads on the dispensing container (not shown).

Still referring to FIGS. 4A-4B, the sleeve 140 may further comprise a barrel 146 having an exterior surface 151 that is substantially tubular in shape. As shown, the exterior surface 151 may be substantially smooth, however in another embodiment the exterior surface 151 not be substantially smooth and may include one or more surface features configured to engage one or more other components of the pump assembly 100 or the dispenser container (not shown). Referring to FIG. 4B, the barrel 146 further comprises an inner space 147 that is defined by an inner surface 149. As shown, the inner surface 149 is substantially smooth and tubular in shape, however in other embodiments, the inner surface 149 may not be substantially smooth and tubular in shape and may include one or more surface features. In an embodiment, the collar 144 may surround a portion of the exterior surface 151 of the barrel 146. In another embodiment, the inner space 147 may extend through at least a portion of the collar 144. Referring to FIG. 4A, the collar 144 may define an opening 143 at the top end 141 of the sleeve 140 that connects to the inner space 147.

Still referring to FIG. 4B, an annular shoulder 150 may extend from a portion of the inner surface 149 into the inner space 147 to define a drawing channel 157. The drawing channel 157 may fluidly connect the inner space 147 to a dip tube channel 152, which is configured to receive at least a portion of a dip tube 196 (FIG. 1). The dip tube channel 152 is defined by an inner channel surface 154 that extends from the drawing channel 157 to an orifice 153. As shown in FIG. 4B, the orifice 153 has a diameter that is larger than the dip tube 196, however in another embodiment, the orifice 153 may have a diameter that is smaller than the diameter of the dip tube 196. In the embodiment illustrated in FIG. 4B, the diameter of the dip tube channel 152 is greater than the diameter of the drawing channel 157, but less than the diameter of the inner space 147. As shown, the inner space 147, the drawing channel 157, and the dip tube channel 152 are fluidly connected.

As illustrated in FIGS. 4A and 4B, the collar 144, the barrel 146, and the coupling portion 148 may be formed as a single component, however in other embodiments, one or more of the collar 144, the barrel 146, and the coupling portion 148 may not be formed as a single component and may be joined together using an adhesive bond/joint, at least one welded joint, or any other suitable means to couple or join the components together.

Figure 5B:
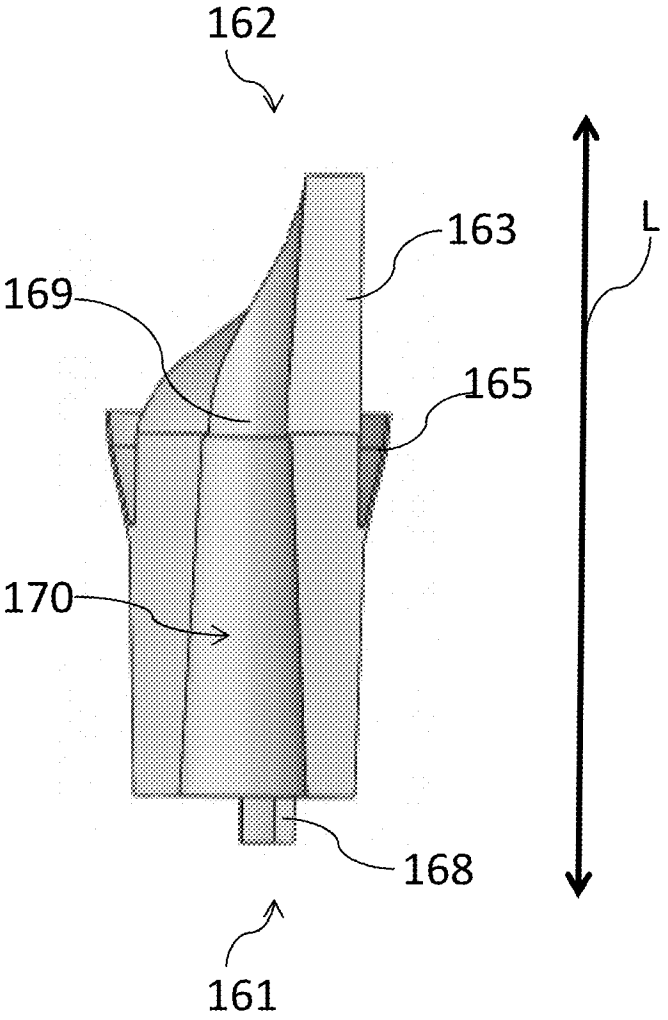
FIG. 5B illustrates a cross-sectional view of the embodiment of the plunger of FIG. 5A.
Figure 5A:
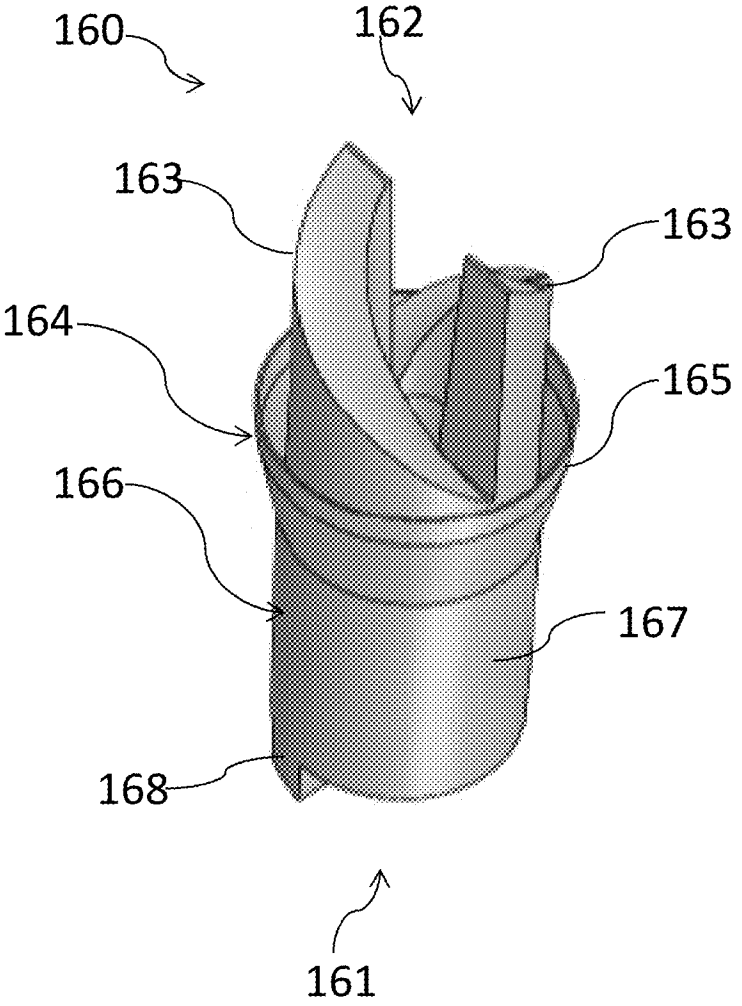
FIG. 5A illustrates an isometric view of an embodiment of a plunger of the pump dispenser.

Referring to FIGS. 5A and 5B, the plunger 160 generally includes a frustum portion 164 proximate a bottom end 162 and a body 166 extending from the frustum portion 164 towards a top end 161 of the plunger 160. The frustum portion 164 may at least partially surround one or more helical fingers 163 that may extend along or be parallel to a longitudinal axis L (FIG. 5B) of the plunger away from the body 166. As shown in FIG. 5A, the frustum portion 164 may comprise one or more annular walls 165 that are positioned at an angle relative to the longitudinal axis L (FIG. 5B) of the plunger. As shown, the one or more annular walls 165 are positioned at an angle that may be less than 90° relative to the longitudinal axis L (FIG. 5B) of the plunger 160.

The body 166 includes an exterior surface 167 that may be substantially smooth, however in other embodiments, the exterior surface 167 may not be substantially smooth and may include one or more surface features. The body 166 may comprise one or more coupling extensions 168, which extend from the body 166 toward the top end 161 of the plunger 160. The one or more coupling extensions 168 may be configured to couple to or cooperate with one or more complimentary features of the cap 110. In an embodiment, the one or more complimentary features of the cap 110 comprise the one or more radial channels 128 (FIG. 3B). Referring to FIG. 5B, the plunger 160 comprises an inner bore 170 that is defined by a bore wall 169. As shown, the inner bore 170 has a diameter that generally decreases from the top end 161 to the bottom end 162 of the plunger 160. However, in other embodiments the diameter of the inner bore 170 may remain constant or fluctuate in diameter along its length to meet desired specifications.

As shown in FIG. 5A, the one or more helical fingers 163 have an arc length that is approximately 50% of the circumference of the inner bore 170. The one or more helical fingers 163 may be generally positioned symmetrically around the circumference of the inner bore 170. In an embodiment, one or more of the components of the plunger 160 may be formed together as a single unitary structure. In an embodiment, one or more of the plunger 160 components may be formed separately and coupled together using at least one adhesive bond or at least one welded joint.

Figure 6:
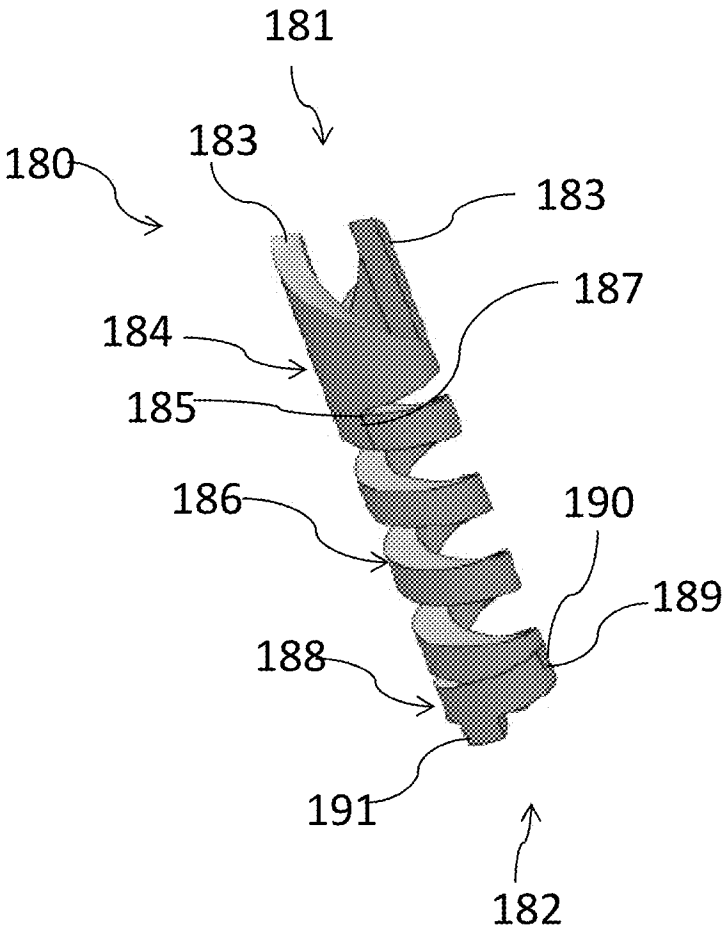
FIG. 6 illustrates an isometric view of an embodiment of a torsion compression spring of the pump assembly.

Referring to FIG. 6, the pump assembly 100 (FIGS. 1-2) further comprises a torsion compression spring 180 having a top end 181 and a bottom end 182. The torsion compression spring 180 generally includes a plunger engagement portion 184, an anchor 188, and a spring helix 186 located between the plunger engagement portion 184 and the anchor 188. As shown, the plunger engagement portion 184 is located at the top end 181 of the torsion compression spring 180 and may be comprised of one or more complimentary helical fingers 183 that are configured to engage the helical fingers 163 of the frustum portion 164 of the plunger 160. The one or more complimentary helical fingers 183 may have an arc length that is approximately 50% of the circumference of the inner bore 170 of the plunger 160. Still referring to FIG. 6, the plunger engagement portion 184 may further comprise a notch 185 or recess configured to engage a first open end 187 of the spring helix 186. The notch 185 may aid in coupling the first open end 187 of the spring helix 186 with the plunger engagement portion 184.

The spring helix 186 may be generally comprised of a plurality of coils and may have approximately the same diameter along its longitudinal axis. The number and pitch of the coils may vary according to the desired stroke length, compression, and torsion characteristics. The spring helix 186 is coupled to the plunger engagement portion 184 at one end and the anchor 188 at an opposing end. Still referring to FIG. 6, the anchor 188 may have substantially the same diameter as the spring helix 186 and may further comprise a notch 189 or recess configured to engage a second open end 190 of the spring helix 186. The coupling element 191 in the anchor 188 may prevent the spring helix 186 from rotating during the pump stroke in order to build up torsion forces as the torsion compression spring 180 is compressed. In an embodiment, one or more components of the torsion compression spring 180 may be formed as a single component. In a further embodiment, the torsion compression spring 180 is formed from multiple components coupled together using adhesive, one or more welded joints, or any other suitable means of coupling.

In the assembled state as shown in FIGS. 1-2, the pump assembly 100 is in a pre-pump position with the torsion compression spring 180 and at least a portion of the plunger 160 positioned within the inner space 147 of the sleeve 140. As shown in FIG. 2, the anchor 188 further comprises a coupling element 191 positioned on the end opposite the notch 189. As shown in FIG. 2, the coupling element 191 may be configured to engage or couple to a portion of the inner surface 149 or annular shoulder 150 of the sleeve 140. At least a portion of the body 166 of the plunger 160 may be located within the interior space 120 of the cap housing 114 of the cap 110. As shown in FIG. 2, the frustum portion 164 of the plunger 160 may contact the inner surface 149 of the sleeve 140 and may act as a wiper seal between the plunger 160 and the sleeve 140.

Figure 7B:
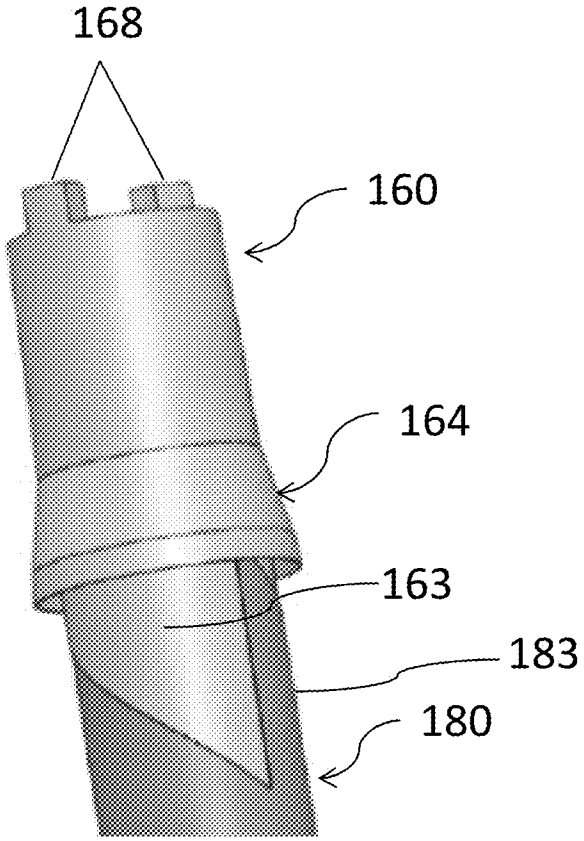
FIG. 7B illustrates an isometric view of the embodiment of the plunger and the torsion compression spring in a fully compressed state.
Figure 7A:
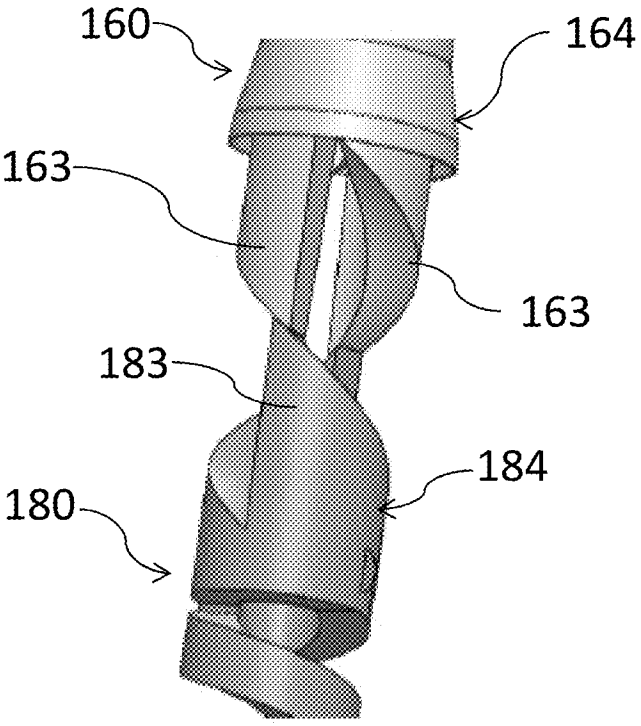
FIG. 7A illustrates an isometric view of an embodiment of the plunger and the torsion compression spring in a pre-compressed state.

Still referring to FIG. 2, the cap 110 may be configured to at least partially surround the collar 144 of the sleeve 140 in the pre-pump position while the helical fingers 163 and complimentary helical fingers 183 may be in contact with each other, but are not engaged (FIG. 7A). During the pump stroke, the cap may be pushed down or compressed, which may result in the collar 144 of the sleeve 140 entering the interior space 120 of the cap housing 114. At the same time, the one or more helical fingers 163 of the plunger ride along the pitch of the one or more complimentary helical fingers 183 of the torsion compression spring 180 as shown in FIG. 7A, until they are in an engaged position as shown in FIG. 7B. As the helical fingers 163 and complimentary helical fingers 183 move from the contact position (FIGS. 2 and 7A) to the engaged position (FIG. 7B), compression and torsion forces are generated. The torsion force is generated due to the pitched surfaces of the helical fingers 163 and complimentary helical fingers 183, which cause rotation of the torsion compression spring as it is compressed, however rotational movement of the opposing or second open end 190 (FIG. 6) of the spring helix 186 is prevented by the notch 189 (FIG. 6) of the anchor 188 (FIG. 6). Rotation of the spring helix 186 may also be prevented by the cap 110.

As the cap 110 is depressed, the plunger 160 generates a compression force, which closes a valve in the dip tube channel 152, pushing the contents of the inner space 147 of the sleeve 140 into the inner bore 170 of the plunger 160 and out through the dispensing channel 122 of the cap 110. When the cap 110 is released, the torsion and compression forces built up in the torsion compression spring 180 are released and the pump assembly 100 returns to a pre-pump state as shown in FIG. 1. As the cap 110 is returned to the undepressed state under the forces stored in the torsion compression spring 180, a valve opens in the dip tube channel 152, pulling contents up the dip tube 196 from the dispensing container (not shown). Accordingly, in the assembled state, the components of the pump assembly 100 are fluidly connected to each other. As shown in FIGS. 1-7B, and as described herein, one or more components of the pump assembly may be manufactured using injection molding or other molding or fabricating processes suitable for making said components.

The cap 110, sleeve 140, plunger 160, the torsion compression spring 180, and the dip tube 196 are manufactured from the same recyclable material, such as polyolefin, or another same type of recyclable material. As referred to herein, the same type of recyclable material refers to material that can be recycled in the same manner or using the same processes, or otherwise does not need to be sorted out or undergo additional processing in order to properly recycle. The same type of recyclable material would also encompass materials that are assigned the same recycling code. The pump assembly as described above is made of the same type of recyclable material such that it may be recycled while in the assembled state as shown in FIGS. 1-2.

Figure 10:
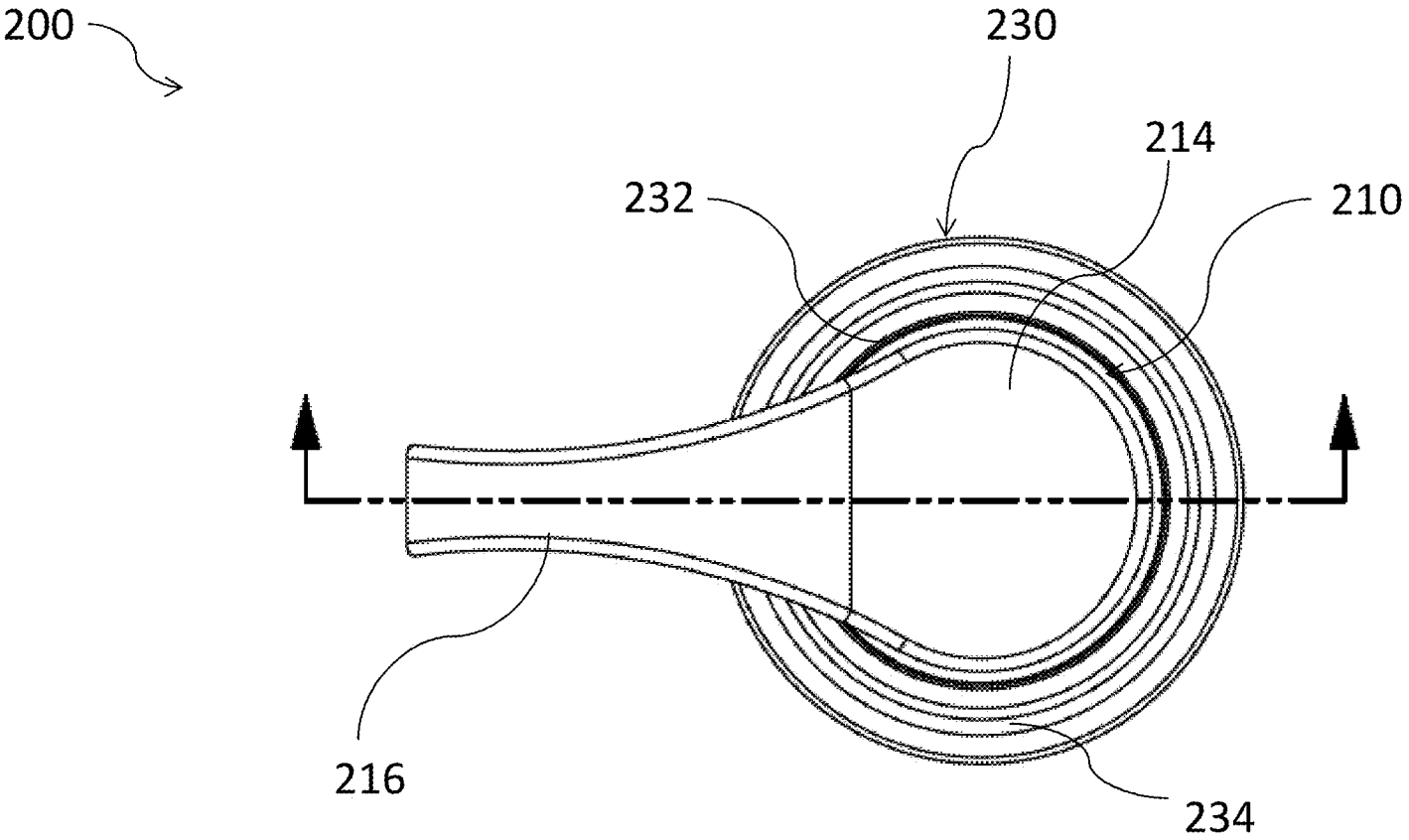
FIG. 10 illustrates a top plan view of an embodiment of the pump assembly.
Figure 11:
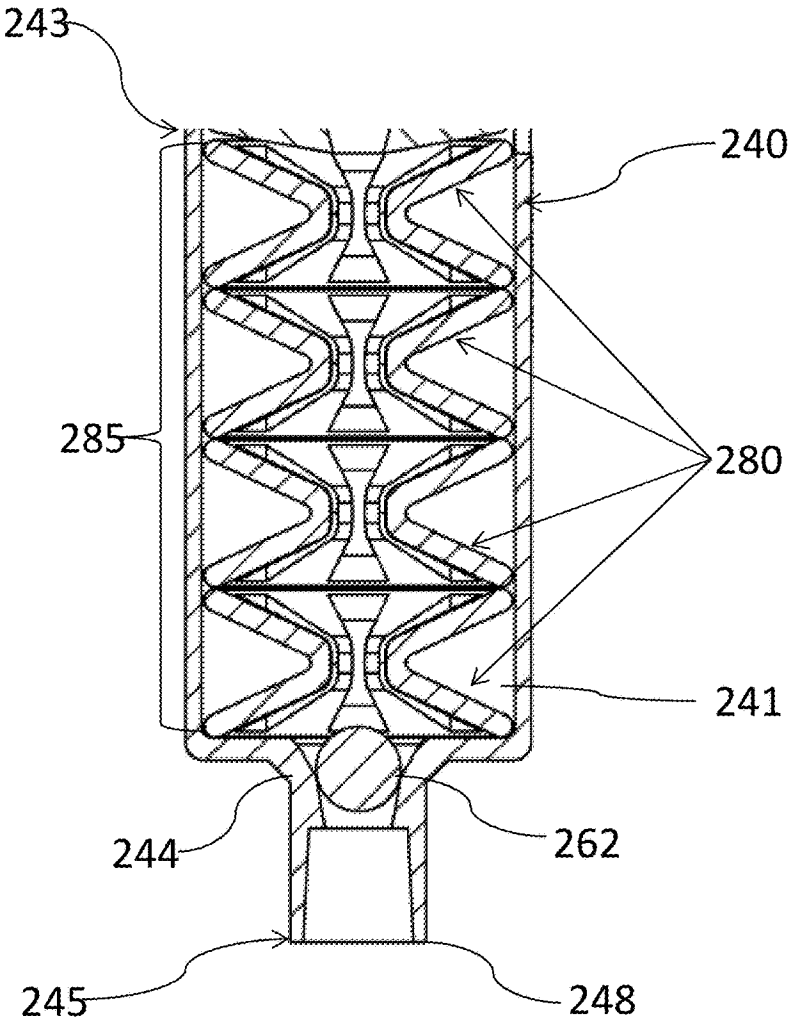
FIG. 11 illustrates a cross section view of an embodiment of a pump assembly housing.
Figure 12:
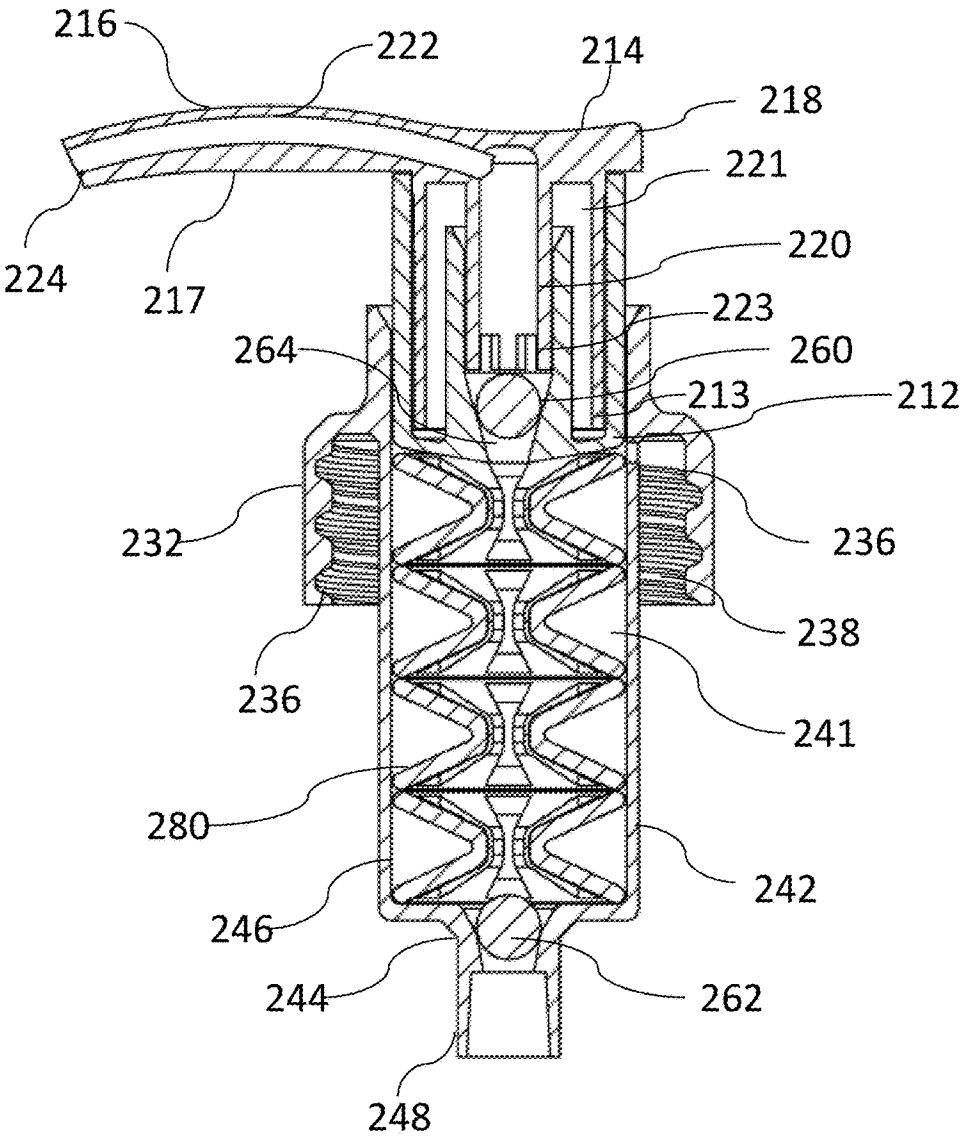
FIG. 12 illustrates a cross section view of an embodiment of the pump assembly sleeve of FIG. 11.

Referring to FIGS. 8-12, another embodiment of the pump assembly 200 for a dispensing container (not shown) has a top end 201 and a bottom end 202 and generally includes a cap 210, a collar 230, a sleeve 240 (FIGS. 8 and 12), one or more valves 260, 262 (FIG. 12), and a plurality of resilient members 280 (FIG. 12).

Figure 8:
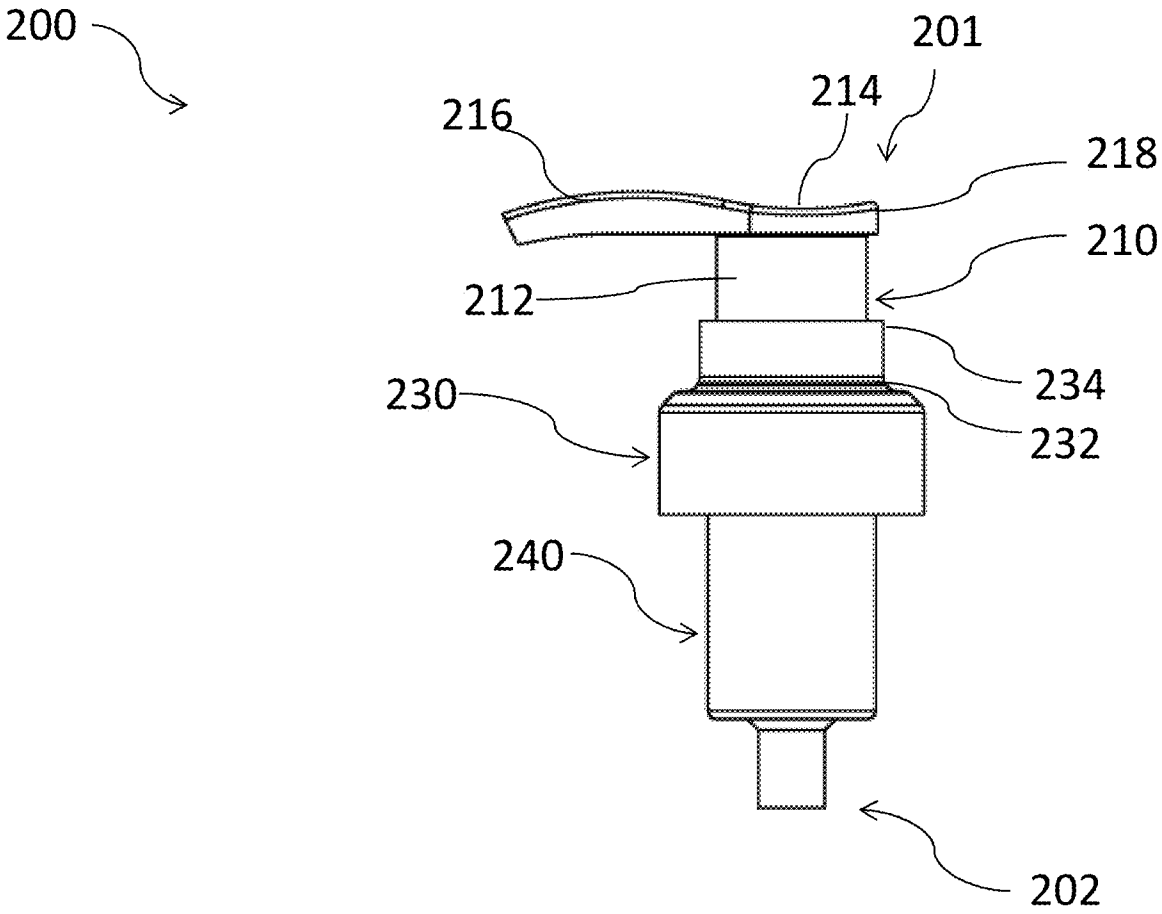
FIG. 8 illustrates a side plan view of another embodiment of the pump assembly.

As shown in FIG. 8, the cap 210 is generally located at a top end 201 of the pump assembly 200. Referring to FIGS. 8-12, the cap 210 comprises an engagement sleeve 212 with a depression surface 214 and a spout 216. As shown in FIG. 12, the engagement sleeve 212 may be substantially cylindrical in shape and may define an interior cavity 221 configured to house additional components of the pump assembly 200. In an embodiment, the engagement sleeve 212 houses a valve 260 and at least a portion of a receiving channel 220 that is configured to receive the contents from a dispensing container (not shown). The receiving channel 220 may connect with a dispensing channel 222 that extends from the receiving channel 220 to an opening 224 in the spout 216. As shown, the dispensing channel 222 is configured to direct the contents of the dispensing container (not shown) from the receiving channel 220, through the spout 216 and out of the opening 224. In an embodiment, the receiving channel 220 and the dispensing channel 222 may be formed as separate components from each other and the cap 210. In another embodiment, at least one of the receiving channel 220 and the dispensing channel 222 may be formed as a single unit with the cap 210.

Still referring to FIG. 12, the valve 260 may be located between the receiving channel 220 and sleeve 240 and may be configured to regulate the flow of material into and out of the receiving channel 220. The valve 260 may be seated in a first valve chamber 264. As shown in the embodiment illustrated in FIG. 12, the first valve chamber 264 is generally frustoconical in shape and has a diameter proximate the receiving channel 220 that is larger than a diameter proximate the collar 230 or sleeve 240. In an embodiment, the receiving channel 220 may comprise one or more coupling features 223 configured to removably couple the receiving channel 220 to the first valve chamber 264. In another embodiment, the receiving channel 220 and the first valve chamber 264 are formed as a single unit with the cap 210 such that they are a single unitary structure. As shown in FIG. 12, the valve 260 may comprise a spherical element that has a maximum diameter that is between the diameter of the first valve chamber 264 proximate the receiving channel 220 an the diameter of the first valve chamber 264 that is proximate the collar 230 or sleeve 240. As shown, the spherical element is able to move within the first valve chamber 264. In another embodiment, the valve 260 may not comprise a spherical element.

As shown in FIG. 12, the cap 210 may further comprise a lip 218 or other similar feature that protrudes in a radial direction from the engagement sleeve 212 or the depression surface 214. In an embodiment, the cap 210 may have one or more engagement features located on a surface of the engagement sleeve 212 that are configured to removably engage with the collar 230 and/or the sleeve 240.

Figure 9:
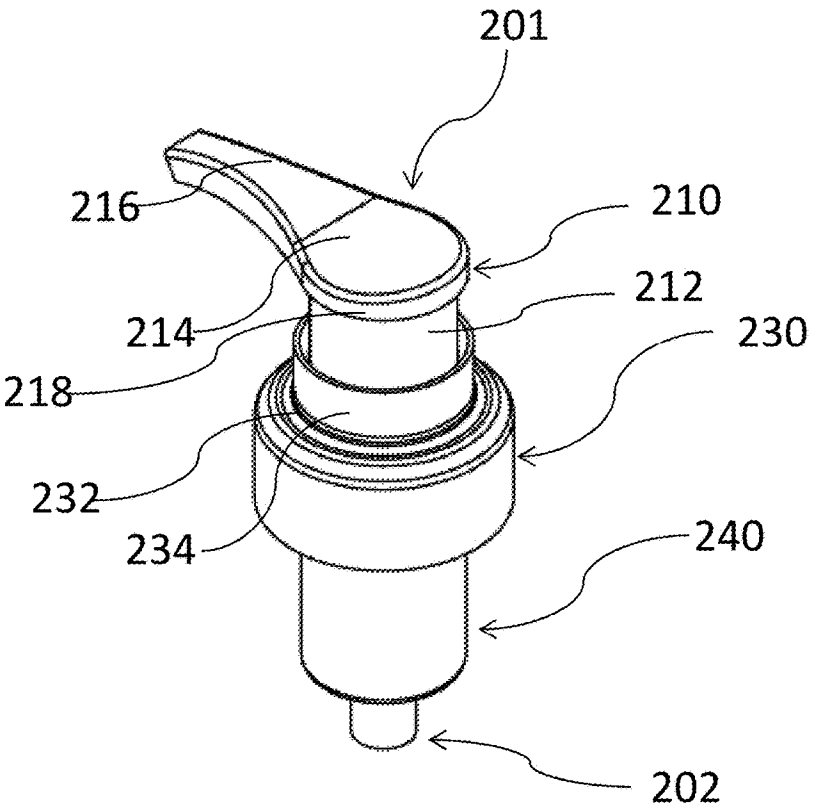
FIG. 9 illustrates a top perspective view of an embodiment of the pump assembly.

Referring to FIGS. 8-10, the collar 230 comprises an exterior surface 232 that surrounds at least a portion of the sleeve 240. As shown specifically in FIG. 9, the exterior surface may comprise one or more different diameters such that the exterior surface 232 may appear to step inward or curve inward as the exterior surface 232 extends towards the cap 210. In an embodiment, the exterior surface 232 of the collar 230 may be substantially smooth, however in other embodiments, the exterior surface 232 of the collar 230 may not be substantially smooth. Referring to FIGS. 8-10, and 12, the collar 230 may further comprise a stop member 234 configured to contact the lip 218 when the cap 210 is depressed. In an embodiment, the lip 218 and a collar facing surface 217 of the spout 216 both contact the stop member 234 when the cap 210 is depressed in order to prevent over compression and breakage of the pump assembly 200.

As shown in FIG. 12, the collar 230 further comprises an interior surface 236 that may include one or more surface features 238 configured to engage one or more complimentary surface features on the dispenser container (not shown). The one or more surface features 238 may be formed as a single unit with the collar 230. In the embodiment shown in FIG. 12, the one or more surface features 238 comprise a plurality of threads. In another embodiment, the one or more surface features may allow for a snap-fit engagement with the dispensing container (not shown).

As illustrated in FIGS. 11-12, the sleeve 240 generally comprises a top end 243 configured to engage a portion of the cap 210 and/or a portion of the collar 230 and a bottom end 245 configured to removably couple to an end of a dip tube (not shown). In an embodiment, the collar 230 and the sleeve 240 comprise two separate components, however in other embodiments, the collar 230 and the sleeve 240 are formed as one piece and are a single unitary component.

The sleeve 240 further comprises an outer surface 242 and an inner surface 246. As shown in FIGS. 8, 9, and 11-12, the sleeve 240 is tubular in shape and the outer surface 242 is substantially smooth. However in other embodiments, the outer surface 242 may not be substantially smooth and may comprise one or more surface features. Referring to FIG. 12, the inner surface 246 defines a sleeve chamber 241 that is configured to house one or more resilient members 280. In an embodiment, the sleeve chamber 241 further comprises a second valve chamber 244 configured to house a second valve 262 that is configured to control the flow of material from the dip tube (not shown) into the sleeve 240. As shown in FIGS. 11-12, the second valve chamber 244 is generally frustoconical in shape and the second valve 262 may comprise a second spherical element that has a maximum diameter that is less than a maximum diameter of the second valve chamber 244. Still referring to FIG. 12, the valve is positioned between the resilient member 280 and a dip tube engagement portion 248. In an embodiment, the pump assembly 200 may comprise a single valve positioned in a single valve chamber. In another embodiment, the one or more valves may be alternatively positioned as compared to the embodiment of FIG. 12. For example, one of the valves may be located within the sleeve chamber 241 and in-between resilient members 280.

As illustrated in the embodiment of FIGS. 11-12, multiple resilient members 280 are stacked on each other to form a resilient member train 285 that is housed in the sleeve chamber 241 and extends between the second valve chamber 244 and the cap 210. The bottom 213 of the cap 210 or the bottom of the sleeve 212 may contact a portion of one of the resilient members 280 such that depression of the cap 210 causes compression of the contacted resilient member 280. The compression of the contacted resilient member 280 in the stacked configuration shown in FIGS. 11-12 imparts a compressive force to the other resilient members 280 of the resilient member train 285. The use of stacked resilient members 280 enables even compression of each resilient member 280, which increases the life of the pump assembly 200. Moreover, using stacked resilient members 280 allows manufacturing of pump assemblies of different sizes without the need to change the manufacturing specifications of the resilient members 280 since one may simply use more or fewer to accommodate different sized pump assemblies 200.

Figure 13:
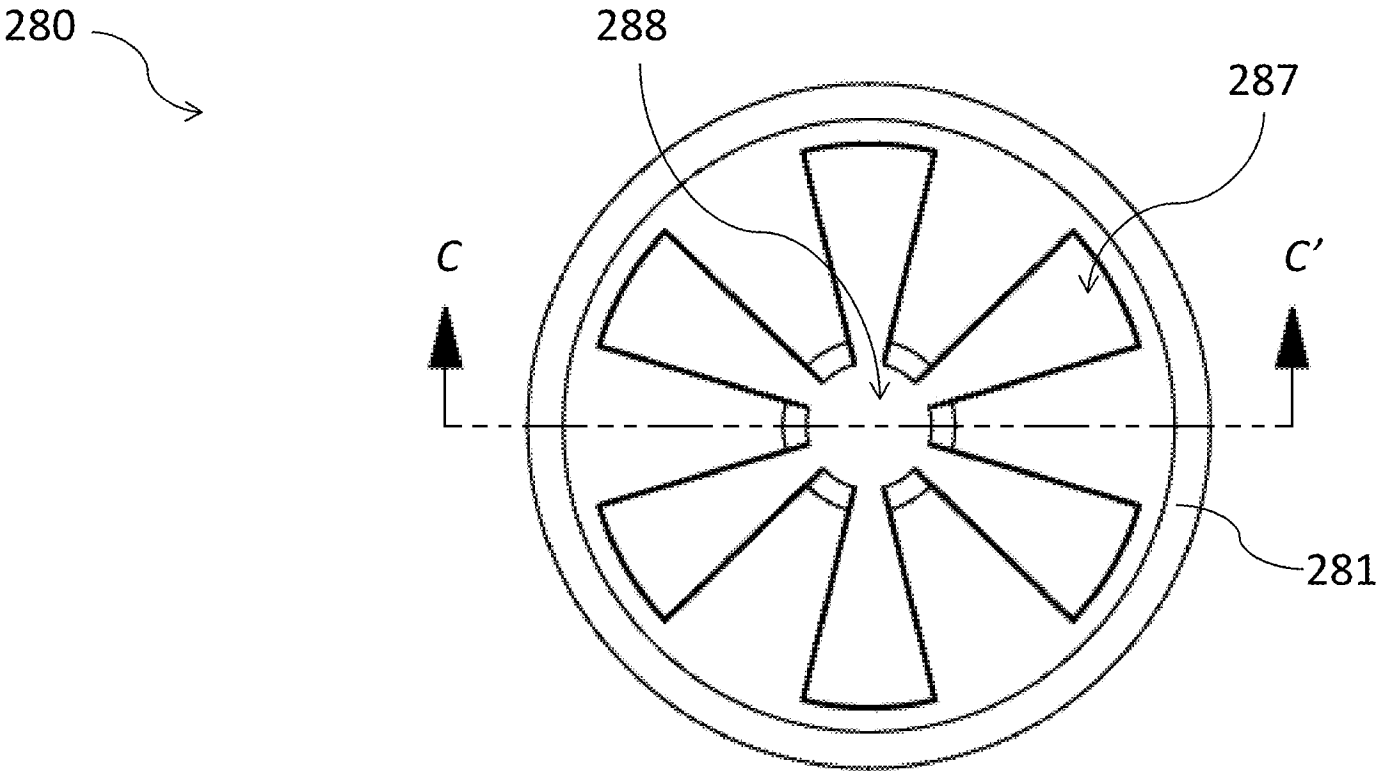
FIG. 13 illustrates a top plan view of the resilient member from FIG. 12.
Figure 14:
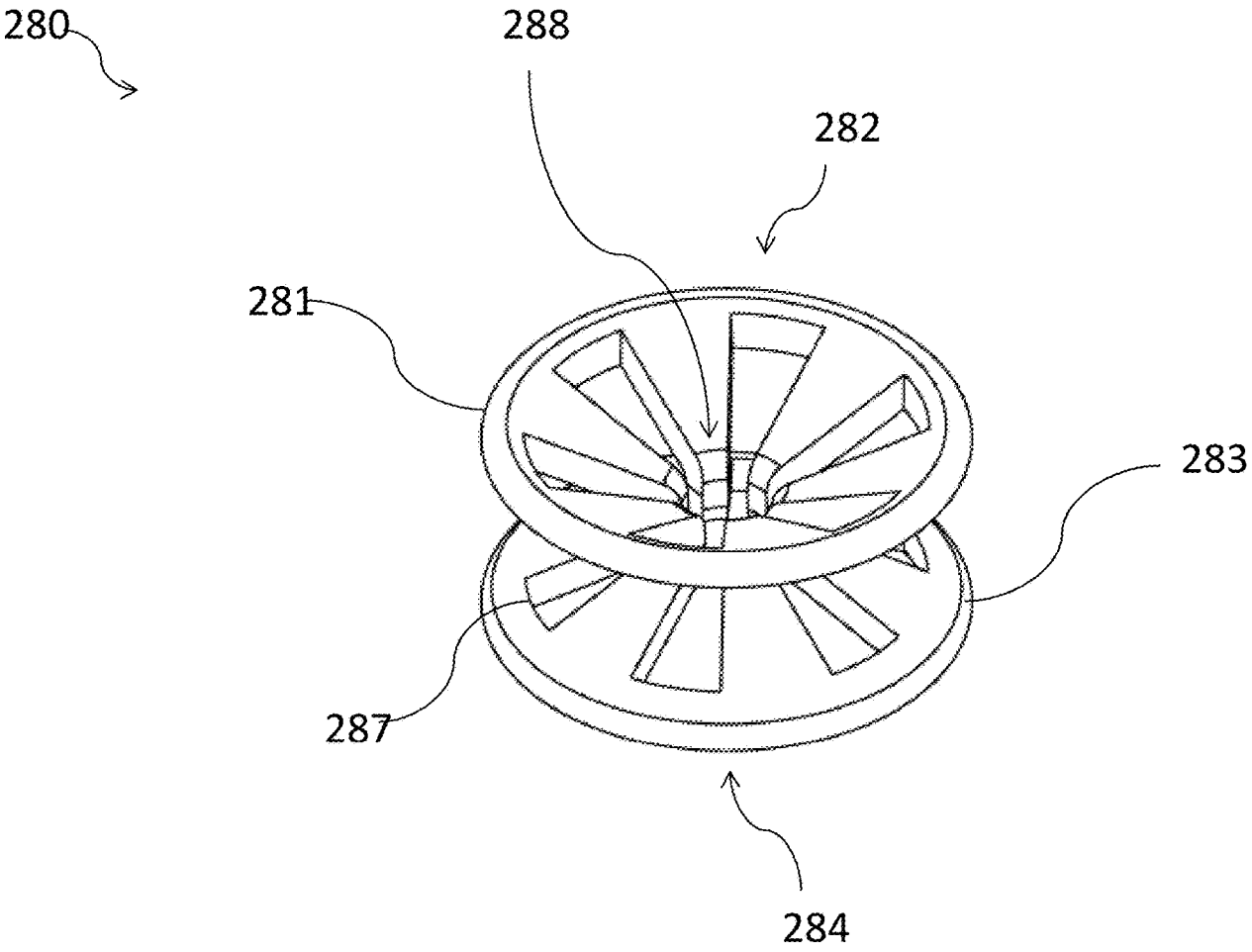
FIG. 14 illustrates a perspective view of an embodiment of a resilient member of the pump assembly.
Figure 15:
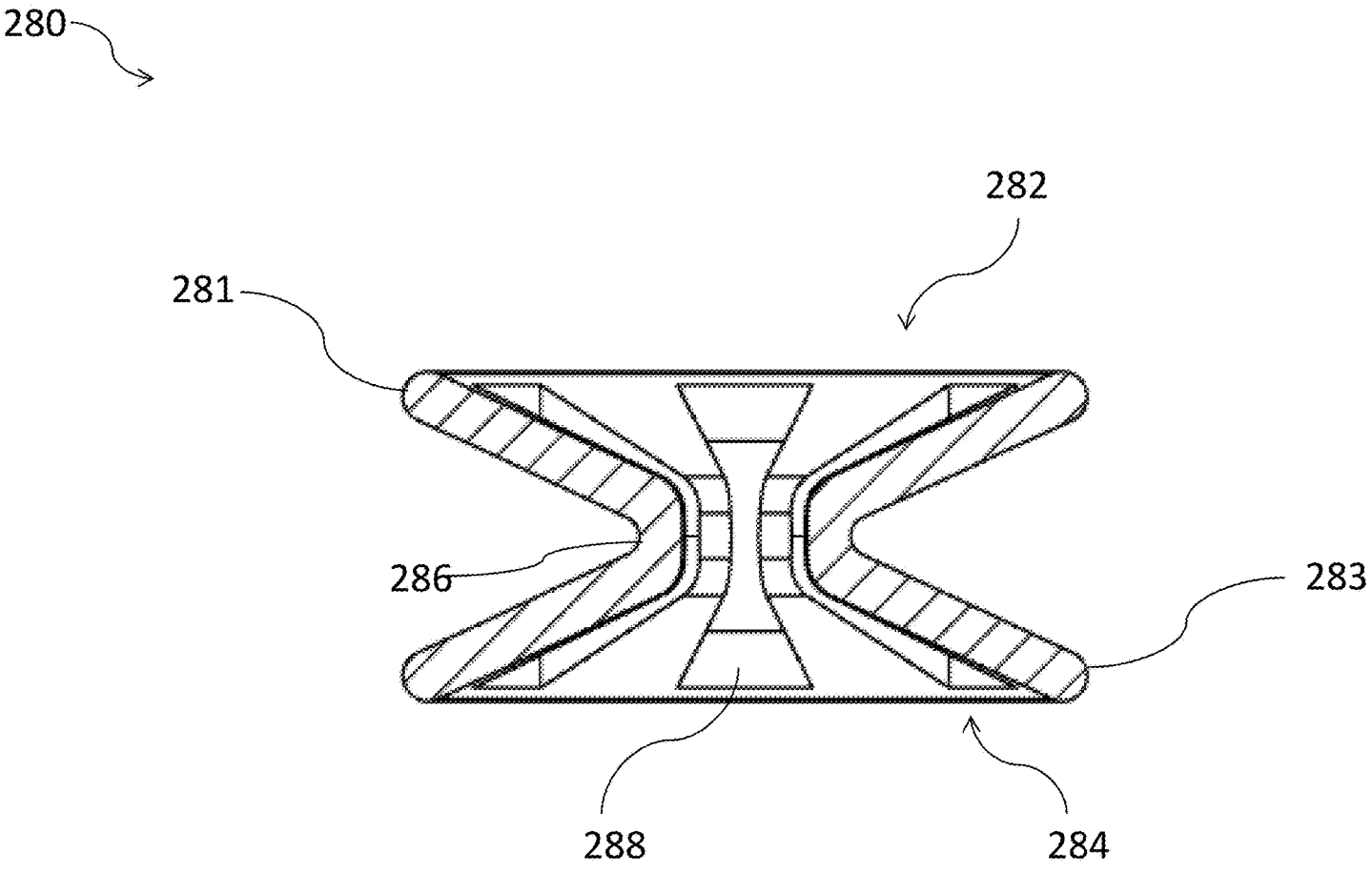
FIG. 15 illustrates a cross section view of the resilient member from FIG. 12 along line C-C'.

Referring to the embodiments illustrated in FIGS. 14-15, the resilient member 280 generally comprises two cone-shaped portions 281, 283 that are coupled together at their apex ends. As shown in the embodiments illustrated in FIGS. 13-15, the resilient member 280 is generally round or circular at each end opposite the apex end. In an embodiment, the maximum circumference of the top end 282 is the same as the maximum diameter of the bottom end 284. Referring to FIGS. 14-15, a junction 286 exists where the resilient member 280 has a minimum diameter. The junction 286 defines a central bore 288 that may be configured to transport material drawn up through the dip tube (not shown) to the conical chamber 264 and receiving channel 220 of the cap 210. In an embodiment, compression of the resilient member train 285 may fluidly connect the central bores 288 of each of the resilient member 280 to each other. In another embodiment, dispensing material from the opening 224 of the cap 210 is not dependent on the movement of material through the inner bore 88 of the one or more resilient members 280.

The resilient member 280 may comprise one or more slots 287 that extend between the top end 282 and the bottom end 284. The slots 287 may be configured to increase the resilience of the resilient member 280 and/or they may be configured to decrease manufacturing costs by allowing the resilient member to be made from less material. In addition, the slots 287 may aid in the flow of material through the sleeve chamber 241. In an embodiment, the resilient member 280 may be a Belleville spring or other compression spring. The resilient member 280 is comprised of the same type of recyclable material as the other components of the pump assembly 200, such as a polyolefin. The same "type" of recyclable material refers to material that is classified under the same recycling code or otherwise classified such that further processing to separate out components of the pump assembly 200 is not required during the recycling process. The pump assembly 200 as described herein is made of the same type of recyclable material such that it may be recycled while in the assembled state as shown in FIGS. 8-10 and 12.

Referring to the assembled state of the pump assembly 200 as illustrated in FIGS. 8, 9, and 12, the dispensing channel 222, receiving channel 220, first valve chamber 264, sleeve 240, second valve chamber 244, and the dip tube engagement portion 248 are fluidly connected to each other. In an embodiment, the central bore(s) 288 of the one or more resilient members 280 may become fluidly connected with the first valve chamber 264 and the second valve chamber 244 when the depression surface 214 of the cap 210 compresses the resilient member train 285 (FIG. 11).

The pump assembly 200 is coupled to a dispending container (not shown) that may contain a liquid, semi-solid, gel-like, emulsified material, or the like to be dispensed. The interior surface features 238 of the collar 230 are configured to engage the complimentary surface features of the dispensing container (not shown). The depression surface 214 is pressed down until the lip 218 and/or the collar facing surface 217 of the spout 216 contacts the stop member 234. Pressing the depression surface 214 causes a portion of the cap 210 to compress the resilient member train 285 (FIG. 11) housed within the sleeve chamber 241. During the compression state, the first and second valves 260, 262 open to allow material from the dispensing container (not shown) to be drawn up into the sleeve 240 and the receiving channel 220, and forced out of the dispensing channel 222. When the resilient member train 285 (FIG. 11) is allowed to decompress, the depression surface 214 returns to its resting position and the first and second valves 260, 262 close to prevent material from the dispensing container (not shown) from moving into the pump assembly 200.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claim. Moreover, although specific terms are employed herein, as well as in the claim which follows, they are used only in a generic and descriptive sense, and not for the purposes of limiting the present disclosure, nor the claims which follow.

The invention claimed is:

1. A pump assembly for a pump dispenser, the pump assembly comprising:

a cap having a housing and a spout;

a collar having a stop member;

a sleeve at least partially positioned within the collar and comprising a sleeve chamber;

at least one valve configured to seal at least one end of the sleeve; and a plurality of resilient members housed within the sleeve chamber, wherein each of the plurality of resilient members comprises two cone-shaped portions, wherein compression of the cap causes compression of the plurality of resilient members and engagement of the cap with the stop member of the collar, wherein the cap, the collar, the sleeve, the at least one valve, and the plurality of resilient members are comprised of a same type of recyclable material and wherein the pump assembly is configured to be recycled in an assembled state.

2. The pump assembly of claim 1, wherein the plurality of resilient members are configured to be stacked within the sleeve chamber.

3. The pump assembly of claim 1, wherein the plurality of resilient members each comprise one or more openings that traverse each of the plurality of resilient members.

4. The pump assembly of claim 3, wherein the plurality of resilient members each comprise at least two portions coupled together, wherein the at least two portions are symmetrical.

5. The pump assembly of claim 4, wherein each of the plurality of resilient members is formed as a single unitary component.

6. The pump assembly of claim 1, further comprising a dip tube configured to couple to an end of the sleeve opposing the cap.

7. A dispenser assembly comprising:

a cap having a housing and a spout;

a collar configured to at least partially receive part of the cap;

a sleeve at least partially positioned within the collar and comprising a sleeve chamber; and a plurality of resilient members housed within the sleeve chamber, wherein each of the plurality of resilient members comprises two cone-shaped portions, wherein compression of the cap causes compression of the plurality of resilient members, and wherein the cap, the collar, the sleeve, and the plurality of resilient members are comprised of a same type of recyclable material and wherein the dispenser assembly is configured to be recycled in an assembled state.

8. The dispenser assembly of claim 7, wherein the plurality of resilient members are configured to be stacked within the sleeve chamber.

9. The dispenser assembly of claim 7, wherein the plurality of resilient members each comprise one or more openings that traverse each of the plurality of resilient members.

10. The dispenser assembly of claim 8, wherein the plurality of resilient members each comprise at least two portions coupled together, wherein the at least two portions are symmetrical.

11. The dispenser assembly of claim 9, wherein each of the plurality of resilient members is formed as a single unitary component.

12. The dispenser assembly of claim 7, further comprising a dip tube configured to couple to an end of the sleeve opposing the cap.

* * * * *